United States Patent [19]

Bonhomme

[11] Patent Number: 4,669,795

[45] Date of Patent: Jun. 2, 1987

[54] CONNECTION DEVICES FOR PRINTED CIRCUIT CARDS

[76] Inventor: Francois R. Bonhomme, 6 Parc de Bearn, 92210 Saint Cloud, France

[21] Appl. No.: 777,211

[22] Filed: Sep. 18, 1985

[30] Foreign Application Priority Data

Sep. 18, 1984 [FR] France ..... 84 14250

[51] Int. Cl.[4] ..... H01R 9/09

[52] U.S. Cl. ..... 439/267; 439/260; 439/633; 439/387

[58] Field of Search ..... 339/74 R, 75 MP, 176 MP

[56] References Cited

U.S. PATENT DOCUMENTS

| | | | |
|---|---|---|---|
| 3,137,537 | 6/1964 | Cole et al. | 339/176 MP |
| 3,526,869 | 9/1970 | Conrad et al. | 339/176 MP |
| 3,553,630 | 1/1971 | Scheingold et al. | 339/176 MP |
| 4,169,644 | 10/1979 | Bonhomme | 339/75 MP |
| 4,553,803 | 11/1985 | Lapraik et al. | 339/74 R |

FOREIGN PATENT DOCUMENTS

| | | | |
|---|---|---|---|
| 2310061 | 11/1976 | France | 339/176 MP |
| 4712267 | 11/1962 | Japan | 339/176 MP |
| 1549201 | 7/1979 | United Kingdom | 339/176 MP |

*Primary Examiner*—John McQuade

*Attorney, Agent, or Firm*—Larson and Taylor

[57] ABSTRACT

The connection device permits the insertion of printed circuit cards without effort. Resilient contact elements have a first portion which, when subjected to the action of a first projection of a slide, urges back a movable contact portion toward the card, and a second portion which, when subjected to the opposed action of a second projection of the slide, urges back the contact portion away from the card.

17 Claims, 9 Drawing Figures

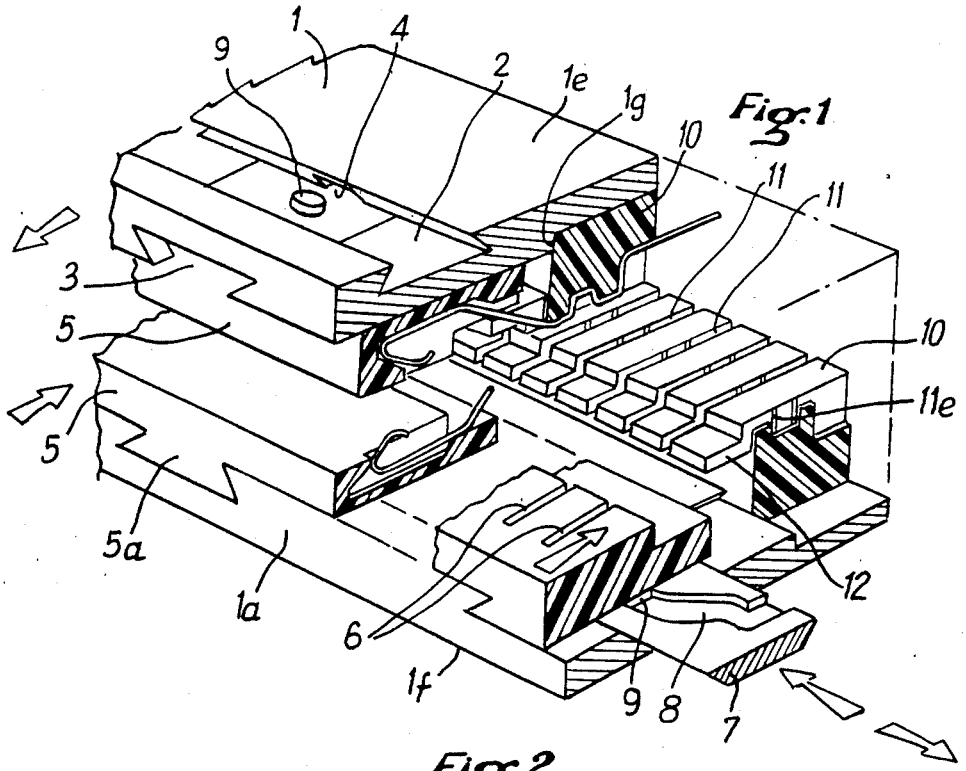
Fig. 1
Fig. 2
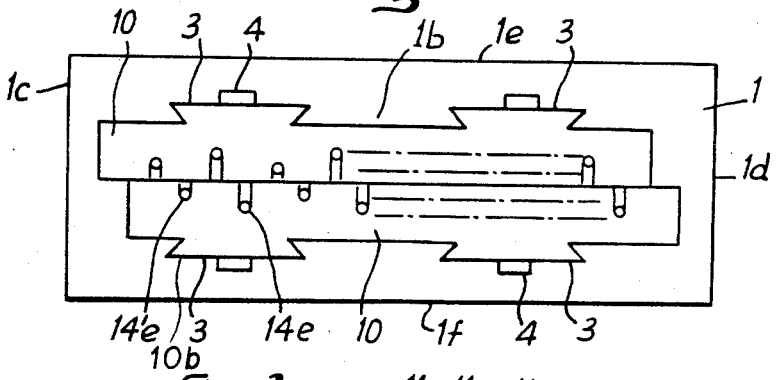
Fig. 3
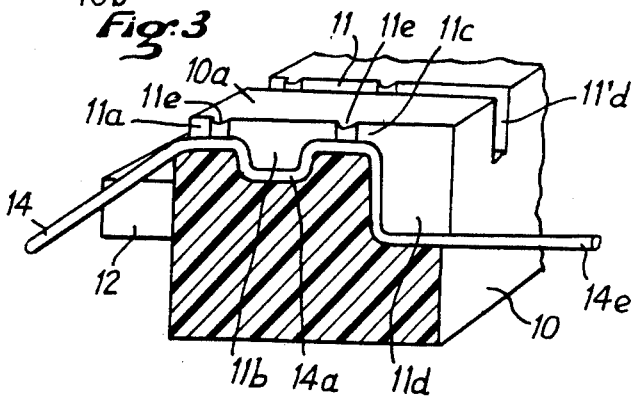

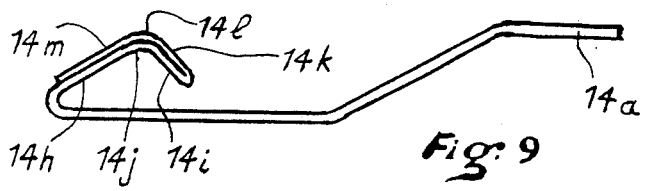
Fig. 9
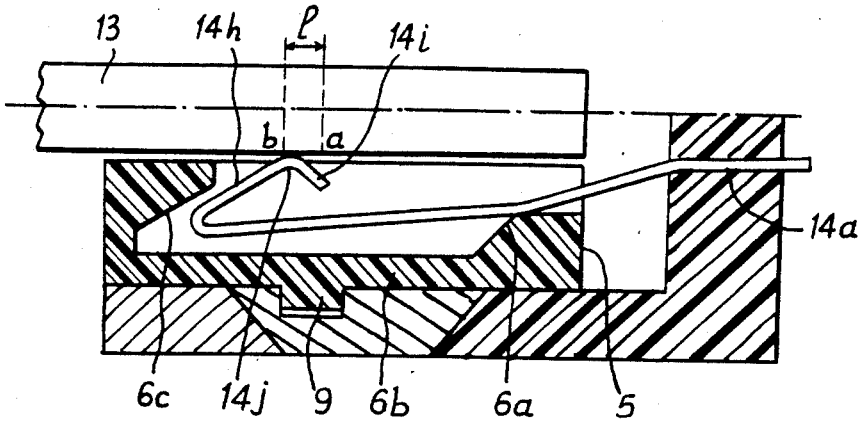
Fig. 7
Fig. 8
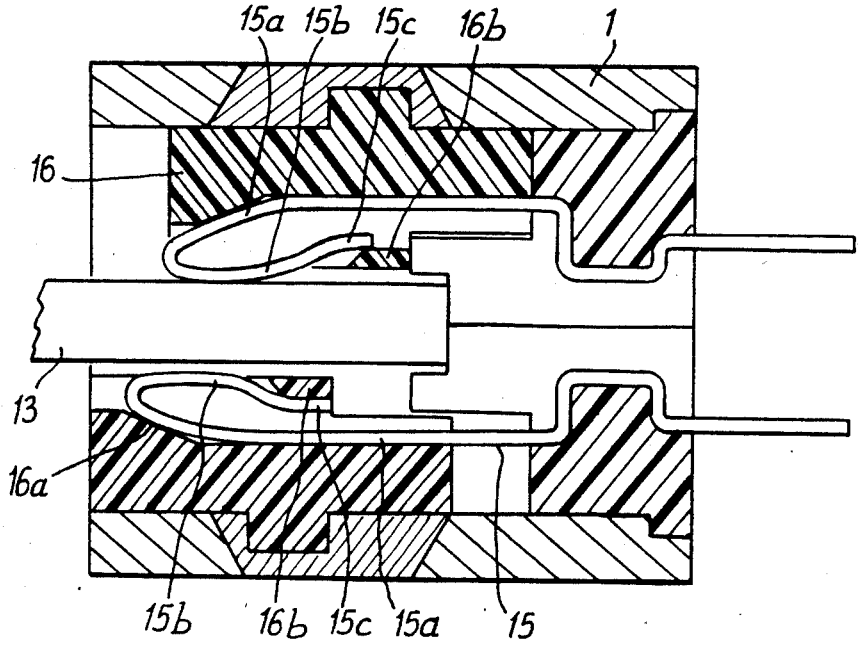

CONNECTION DEVICES FOR PRINTED CIRCUIT CARDS

The present invention relates to connection devices for printed circuit cards which comprise a frame or case having an inserting side for the printed circuit cards and, at least on one side of the card, a group of resilient contact elements oriented transversely relative to the card and adapted to touch by an active zone, with an appropriate resilient force, conductive connection tracks disposed on the adjacent side of the card when the latter has been inserted in the frame or case of the connection device after havng been guided in the median plane of the device, and in which is provided a control mechanism provided for the operator and capable of acting on the resilient elements of these devices alternately in the closing direction so as to permit the insertion of a printed circuit card with zero force into the connection device when the contacts are moved away from the card by said mechanism and, on the contrary, to apply to contact elements with a given resilient force on the tracks or areas of the printed circuit card when the resilient contact elements have been brought to the closing position.

Devices of this type are, for example, disclosed in French Pat. No. 2,305,095 of the applicant filed on Mar. 20, 1975 and in the certificate of addition to this U.S. Pat. No. 2,340,665 filed on Feb. 6, 1976.

The drawbacks of many connection devices for printed circuit cards are due to the fact that, in the course of the closing movement, the resilient contact elements are applied on the conductive tracks of the card in a direction perpendicular to the latter, so that it is not possible to achieve a good contact quality when the tracks and/or the contact elements have undergone an oxidation or have their surface quality impaired in some other way. This is why it has already been arranged in the aforementioned patents, to give to the resilient contact element a component of movement parallel to the plane of the tracks, that is usually to the plane of the card, so as to produce, in the course of the closing movement, a sweeping in which after the zone of contact of the resilient contact element has encountered the surface of the track, the continuation of the movement permits this zone of contact to slide a certain distance along the track and thereby produce a sweeping action ensuring a self-cleaning effect.

These devices have been found very satisfactory in practice, but nonetheless have several drawbacks. In particular, at least in respect of relatively simple forms of contact elements, the resilient leverage, i.e. the mean length between the zone of the contact element which bears against the card track and the point at which the contact element is fixed or anchored to the movable control element of the actuating mechanism is relatively limited, which may be a drawback in some cases. Moreover, the overall size of the contact elements in the direction perpendicular to the printed circuit cards depends on the length of the resilient leverage just defined and this leads to a compromise between these two characteristics, which however does not enable this overall size to be reduced considerably and this affects the width of the connection device, in particular in the case where the latter has two rows of resilient contact elements on each side of the plane of the printed circuit card. Thus, in practice, this width is on the order of 27 mm in respect of a device having two rows of contact elements, whereas it is very advantageous to reduce this overall size in modern equipment.

An object of the present invention is therefore to improve these devices and, in a connection device of the type having at least one row of contact elements and a control mechanism provided for the operator for moving the contact elements away from or toward the tracks of the printed circuit card as a function of the opening or closing movement of said mechanism in accordance with a complex movement producing the self-cleaning of the contact surfaces, to increase the resilient leverage of the contact elements relative to the general dimensions of said device and to reduce the overall width of said device.

Another object of the invention is to achieve such an improvement so as to produce and then eliminate the contact between the contact elements and the tracks of the printed circuit area in a sure and reliable manner.

A further object of the invention is to achieve such an improvement so as to provide an assembly which may be to a great extent, or even completely, automatized.

A still further object of the invention is to provide such an improvement in which the component parts of the mechanism have improved features.

The invention provides an improvement in connection devices for printed circuit cards of the type comprising, in a case having an open side for inserting the printed circuit cards, at least one group having a row of resilient contact elements oriented transversely of the printed circuit card, and a control mechanism provided for the operator or for an actuating means and acting on said resilient elements of a row through a movable member or slide for achieving alternately, in a closing movement, the application of the resilient contact elements against the tracks of the printed circuit card in accordance with a movement including a self-cleaning rubbing travel, and, in an opening movement, the movement of said resilient contact elements away from the corresponding tracks of the printed circuit card, wherein the resilient contact elements have a generally elongated shape extending along the plane of the printed circuit card with a first portion permitting an urging of the movable part of the contact element toward the printed circuit card when it is acted upon by a first part of a mechanism member or slide moving in a direction parallel to the plane of the printed circuit card in the closing direction, and a second portion remote from the first portion and capable of bringing said movable part of the contact element to its initial position spaced away from the printed circuit card, when it is acted upon by a second part of said slide in the opposite closing direction.

Preferably, the zone of contact proper of the resilient contact element is disposed adjacent to a free end of said resilient contact element in the vicinity of the second part of the member or slide but, by way of a modification, this zone may be disposed in a position between said first and second portions.

Particularly advantageously, the resilient contact element may comprise, extending from its zone in which it is fixed in the corresponding connector, a first portion inclined in a direction which progressively spaces it away from the plane of the printed circuit card and adapted to cooperate with a projection, boss or ramp of the slide having a tendency to swing this portion, in opposition to the action of its resilient resistance, toward the plane of the printed circuit card, this first portion being extended, at a certain distance, by a second portion through an acute angled bend and capable of cooperating with a second projection, boss or ramp of the slide which urges said second portion away from the printed circuit card when the slide moves in the opposite direction, the dimensions and inclinations of the contact portions being of course such that, when one of the projections or ramps of the slide progressively comes into action, the other progressively ceases its action.

The zone of contact is advantageously located at the free end of said second portion and it will be understood that, when the first portion is urged by the first part of the slide moving in the closing direction, the swinging of this first portion finally brings the contact zone in contact with the corresponding track of the printed circuit card, after which the continuation of the movement of the slide which causes a further swinging of the first portion results in a modification of the length of the resilient contact element bringing about a movement of the contact zone applied against the printed circuit card in a given self-cleaning rubbing travel.

According to an improvement of the invention, the resilient contact element, which may be for example made from a round-section, square-section, rectangular-section or other section resilient metal wire, or from a winding of a plurality of twisted wires, has a zone in which it is fixed in the case of the connection device, provided with one or more folds cooperating with a cavity of corresponding shape for an axial immobilisation of the contact element and in the plane of the latter, the cavity being in the form of a slot in a connector contact-carrying bar open at one of its ends for the insertion, by a transverse movement, of the contact, the cavities advantageously having bosses or splines permitting a clamping of the contacts in their cavities and their positioning relative to a reference face.

Advantageously, the depths of these cavities may vary alternately so as to permit the use of contacts of slightly different shapes having a tail portion extending out of the contact-carrying element alternately at different levels so as to increase the distance between neighbouring contact tail portions and facilitate the connection of the contacts to the corresponding conductors The movable member of the mechanism, hereinafter termed slide, is preferably made from an injected plastics material and has a plurality of cavities, with the same pitch as the contact elements, in which the movable parts of the latter are movable in the plane of the cavity, each cavity having a first boss or ramp adapted to urge the first portion of the contact element in the closing direction, and a second boss or ramp having an opposite orientation which positively tends to move the second portion away from the printed circuit card in the closed position and to maintain it in this position.

These slides may advantageously cooperate with mechanism bars, preferably also made from injected plastics material and movable in a direction parallel to the row of contact elements, i.e. in the direction of the length of the connection device of the invention, and therefore in a direction perpendicular to the direction of movement of the slide or slides, the transmission of the movement from the bar to the slide being achieved in the known manner by a ramp effect, owing, for example, to injection moulded studs presented by the slide and penetrating in inclined injection-moulded passageways in the shifting bar, the slides and the bars being preferably guided in the case of the connection device by a sliding assembly of the dove-tail type.

Further features and advantages of the invention will be apparent from the following description given by way of a non-limiting example with reference to the accompanying drawings in which:

FIG. 1 is a diagrammatic view with a part cut away of a connection device according to the invention;

FIG. 2 is a rear view of this device in the region of the exits of the contact tail portions;

FIG. 3 is a perspective view with a section in the region of a cavity of a connector contact-carrying bar;

FIGS. 5, 6 and 7 show different stages in the movement and the operation of an individual resilient contact element of this device;

FIG. 8 is a cross-sectional view of another embodiment of this device;

FIG. 9 is a view of a resilient contact element according to a modification of the invention.

Figure 4:
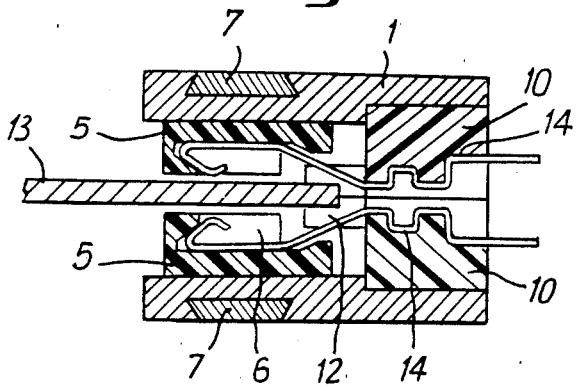
FIG. 4 is a general cross-sectional view of the device shown in FIG. 1.

Reference will first be made to FIGS. 1 to 4.

The illustrated device comprises a case 1 which has a rectangular-sided shape and presents a transverse passageway opening onto the front side 1*a* which constitutes the side receiving the printed circuit card and onto the rear side 1*b* which presents the tail portions of the contact elements, the end sides 1*c* and 1*d* being planar and continuous while the lateral sides 1*e* and 1*f* have, within the thickness of the wall, two dove-tail grooves 2. The space within the case constitutes a passageway whose section can be seen in FIGS. 1, 2 and 4 with spaced-apart dove-tail grooves 3 perpendicular to the grooves 2 and opening onto the latter at crossing points. The bottom of the dove-tail grooves 3 also includes, adjacent to the front side, small grooves 4 whose function will be apparent hereinafter.

Inserted in the opening of the case 1, are two slides 5 each of which has two dove-tail projections 5a which are slidably mounted in the grooves 3 so that these slides 5 are capable of undergoing a reciprocating sliding movement in a direction parallel to the direction of insertion of the printed circuit card. These slides 5 have a plurality of recesses 6 whose shape will be described in more detail hereinafter, these recesses being disposed at the base of the resilient contact elements.

For the reciprocating movemets of the slides 5, in the closing and opening directions, the device comprises two mechanism bars 7 made, as are the other component parts, from an injection moulded material and slidable in the dove-tail grooves 2 transversely of the sliding direction of the slides 5. These bars 7 have grooves 8 in the form of a ramp or cam whose depth is less than the thickness of the bar, and which open onto the rear side and in which engage studs 9 of the parts 5*a* of the slides 5, these studs having taken up their position in passing though the grooves 4, which grooves 4 are shown in FIGS. 1 and 2. It will therefore be understood that the shifting of the bars 7 causes the sliding of the slides 5 in the direction of the arrows by the camming effect between parts 8 and 9.

Disposed in the rear part of the passageway of the case are two connector bars 10, also referred to as contact carrying bars, whose bodies bear against a shoulder 1*g* of the case so as to determine their position exactly. As best seen in FIG. 1, connector bars 10 have portions 10b which are mounted in the first dove-tail grooves 3. These connector bars 10, which are also made from an injection moulded material, have a plurality of recesses 11 at the same pitch as the resilient contact elements and having a shape which is best seen in FIG. 3. Between each pair of successive recesses 11, the bar 10 has an extension 12, all the extensions 12 of both contact-carrying bars 10, forming a cavity receiving and guiding the end of the printed circuit card 13, as can be seen in FIG. 4. It will be understood that these extensions 12 may be omitted or replaced by different formations. Also, by way of a modification, the case may be provided with an inner end member interposed between the two contact-carrying bars 10 and provided with a cavity receiving the end of the printed circuit card 13.

All of the various component parts may be after assembly suitably held or fixed in position, for example by adhesion.

The recesses 11 are in the form of slots formed at the same pitch as the contact elements, in the contact-carrying bars 10, these slots opening onto the whole of the central side 10*a* of these bars. It can be seen that these cavities 11, in the form of slots, have a relatively small depth starting at that end 11*a* close to the extensions 12, with thereafter a deeper part 11*b* followed by another less deep part 11*c* similar to the part 11*a*, followed by a much deeper part 11d which allows the tail portion of the contact element to issue from the slot. It can also be seen that the resilient contact element 14 has a fixing portion 14a which matches the shapes of the cavity parts 11*a*, 11*b*, 11*c* and 11*d* out of which the contact tail portion 14*e* extends.

Further, it can be seen from FIGS. 2 and 3 that in each contact-carrying bar 10, the end parts 11*d*, 11'*d* of the cavities are alternately of different depths, the parts 11*d* being deeper than the parts 11'*d*, the difference in level being preferably standardized, for example at 1.27 mm corresponding to the pitch of the cavities 11. As the contact elements 14 have corresponding shapes, it can be seen that the tail portions 14*e*, 14'*e* are similarly disposed in alternating relation. Preferably the two contact-carrying bars are disposed in the case, the passageway of which is correspondingly shaped, so that the cavities 11 of the respective two contact-carrying bars 10 are not located one in front of the other so as to avoid a risk of an electric contact between two confronting resilient contact elements 14. This arrangement, shown in FIG. 2, moreover allows the use of identical contact-carrying bars 10 for a given case 1.

As shown, furthermore, the cavities 11 include, each time on a given side, ribs 11*e* extending from the side 10*a* these ribs being adapted to form narrowed parts permitting a forced engagement of the contact elements 14 in the cavities 11 and the maintenance thereof in these cavities, these ribs 11 moreover applying the contact elements 14 against the side of the cavity 11 opposed to that carrying the ribs and constituting a geometric reference surface.

Figure 5:
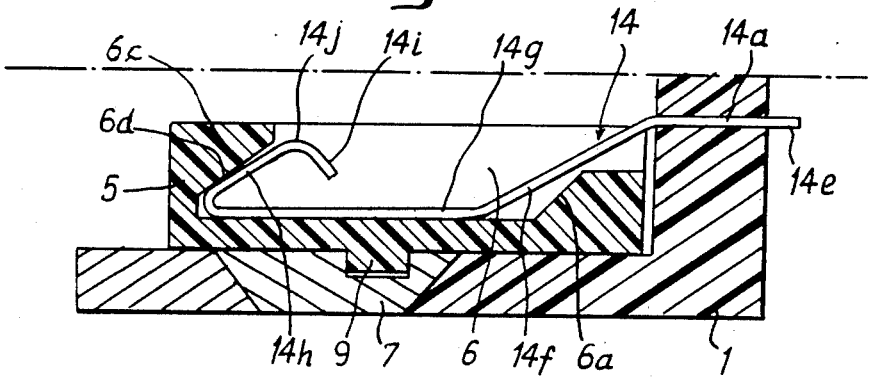
Figure 6:
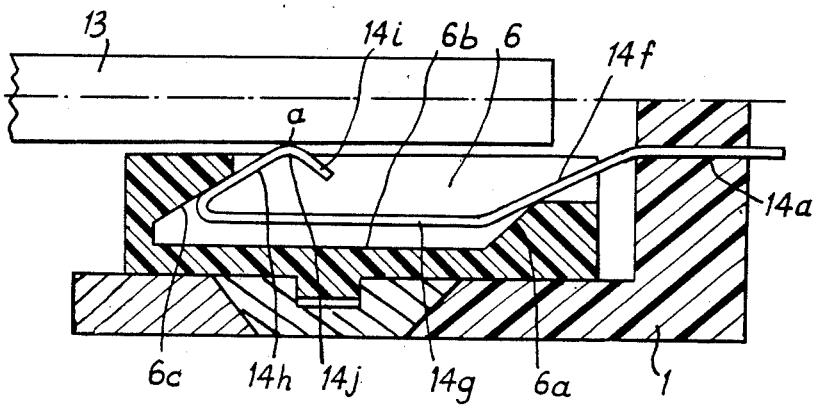

Reference will now be made to FIGS. 5 to 7, it being understood that, for reasons of simplicity of the drawings, it was assumed that the contact elements 14 were directly immobilized by their tail portions 14*e* in the case 1.

The contact elements 14 have, starting at the immobilizing portion 14*a*, a first portion 14*f* forming a descending branch extending progressively away from the printed circuit card 13 and connected, after an obtuse angle to a rectilinear portion 14*g*. At the end of the latter, an acute-angled bend leads to a second portion 14*h* which therefore extends toward the printed circuit card 13 and has at its end an end portion 14*i*, a bend 14*j* interconnecting the portions 14*h* and 14*i* constituting the electric contact zone proper.

The recesses 6 of the slides 5 have a bottom provided on the rear side, with a first inclined ramp or cam 6*a* followed by a rectilinear bottom 6*b*, after which a return configuration 6*c* forms a second part 6*d* in the form of a ramp or cam, this time facing downwardly in contrast to the cam part 6*a*, the recess communicating with the exterior at the end of the cam part 6*d*.

As can be seen, the dimensions are such that, when the slide 5 is in its rear open position shown in FIG. 5, the first part 6*a* of the slide is spaced away from the portion 14*f* of the resilient contact element while the slide part 6*c* retains the inclined portion 14*h* of the resilient contact element in a position spaced away from the printed circuit card 13, in opposition to the resilient return force of the contact element which tends to urge the contact portion 14*j* toward the printed circuit card.

When, in actuating the corresponding bar 7, the slide is shifted forwardly toward its closing position, as represented in FIG. 6, the second slide cam 6*d* moves away from the branch 14*h* which can therefore move toward the printed circuit card 13, while the first cam 6*a*, which comes into contact with the portion 14*f*, urges it back by swinging it about the pivot point located in the zone 14*a* so as to move it toward the printed circuit card 13 so that contact zone 14*j* is applied against the confronting track (not shown) of the printed circuit card 13.

If thenceforth the slide 5 is continued to be shifted forwardly, the cam part 6*a* moves the portion 14*f* still further in the horizontal direction and opens still further the angle between the portions 14*f* and 14*g* of the resilient contact element so that not only is the contact zone part 14*j* applied with greater force against the track of the printed circuit card 13, but there is produced a modification in the length of the contact element 14 which results in a rubbing sliding of the zone 14*j* against the printed circuit card in a travel l between point a where it first came into contact with the card and point b which corresponds to the extreme closing contact position, this movement therefore achieving a self-cleaning of the contact surfaces.

If thereafter, the slide 5 is returned in the opposite direction, the reverse movement is produced and the slide cam 6*d* finally comes into contact with the portion 14*h* which is progressively returned downwardly away from the printed circuit card to the position represented in FIG. 5 where any risk of electric contact between the portion 14*j* and the printed circuit card is impossible.

It will be understood that the illustrated device may be subjected to many modifications.

With reference more particularly to FIG. 8, there is shown a modification in which a resilient contact element 15 has a portion or length 15*a* which extends in a rectilinear manner and substantially parallel to the printed circuit card 13 and then, after a bend following on the first branch 15*a*, a second branch 15*b* returning in a direction substantially parallel to the branch 15*a*, this branch 15*b* terminating in an end portion 15*c*. The slide 16, which is similar to the slide 5, has a first slide part forming a cam or ramp 16*a* in contact with that end portion of the branch 15*a* which starts to curve. The recess in which the branches 15*a* and 15*b* of the contact element extend also has a boss 16*b* which, in the open position shown in the lower part of FIG. 8, is applied against the end portion 15*c* of the resilient contact element and prevents the latter, and consequently also the portion 15*b*, from approaching the printed circuit card 13. If the slide 16 is then shifted to the right of FIG. 8, as shown in the upper part of the latter, it will be understood that the part 16*a* of the cavity urges the curved end portion of the branch 15*a* upwardly toward the printed circuit card while the boss 16*b*, in moving away, progressively releases the branch 15*b* which can then come into contact with the printed circuit card on the corresponding track, the continuation of the movement of the part 16*a* of the slide producing simultaneously a shortening of the length of the contact element 15 and consequently a self-cleaning rubbing.

The connection device according to the invention is assembled in the following manner:

The resilient contact elements 14 are formed and bent in an automatic machine which as each contact element is formed mounts it with a certain force owing to the presence of the ribs 11*e*, in the cavities 11 of the contact-carrying bar 10. The machine is designed to form alternately contact elements corresponding to the cavity parts 11*d* and 11'*d*.

The two bars 7 are placed in position in the grooves 2 of the case 1 so that the openings of the grooves 8 are disposed in alignment with the grooves 4. Then the two slides 5 are mounted in the case 1 until the studs 9, in passing through the passageways 4, enter the grooves 8. It is now possible to shift the bars longitudinally and consequently shift the slides transversely.

Lastly the two contact-carrying bars 10, provided with their contact elements 14, are placed in position through the rear side of the case, the bars 10 also having dove-tail extensions which enter the grooves 3 following on the slides 5. During this movement, the movable portions of the contact elements 14 are placed in the recesses 6 of the slides 5. The contact-carrying bars 10, which are applied against the shoulders 1*g*, are held in position by adhesion, by ultrasonic welding, or by any other method.

With reference to FIG. 9, there is represented an embodiment of a resilient contact element whereby it is possible to obtain two points of contact on the track of the printed circuit card. The contact element is formed by a wire and differs from the contact element 14 in that the free end portion 14*i* is extended by a bent-back portion forming a rising branch 14*k* similar to the end branch 14*i*, a bend 14*l* constituting the contact point proper and a descending free end branch 14*m* which cooperates with the cam 6*d* in the same way as the branch 14*h*. The contact point 14*l* must normally be located at a level slightly higher than, or at least equal to, that of point 14*j* so that, upon application of pressure, it is certain that it comes into contact with the track.

What is claimed is:

1. A connection device for printed circuit cards having a general plane and circuit tracks, said device comprising a case having an open side for inserting the printed circuit cards, at least one unit including a row of resilient contact elements which are oriented transversely of the printed circuit card when the printed circuit card is inserted in the case, each contact element extending from a retained portion at which it is retained by the case, toward a free end, and including a control mechanim, said control mechanism comprising a movable means mounted in said case and movable in a direction parallel to said direction of movement of the printed circuit card alternately in a contact closing direction for acting upon and urging said contact elements against said tracks in a manner to cause contact zones of the contact elements located in the vicinity of their free ends to wipe on said tracks and achieve a self-cleaning effect, and in a contact opening direction for ensuring the movement of said contact elements away from the corresponding tracks of the printed circuit card, each of said contact elements having a generally elongated shape extending alongside said plane of the printed circuit card and comprising a movable portion, said movable portion having a first portion located closer to the retained portion and a second portion remote from said first portion and located closer to the said free end, and an intermediate portion connecting the first and second portions, said second portion being bent at an angle back toward the retained portion before reaching the contact zone, said movable means comprising a first part and a second part, said first part positioned adjacent the said first portions to push the movable portions toward the printed circuit card when the movable means is moved away from the retained portions of the contact elements, said second part facing generally away from the printed circuit card toward the said second portions of the contact elements, and positioned to engage the second portions and move the contact elements away from the printed circuit card and hold the contact elements away from the printed circuit card when the movable means is moved toward the retained portions, and to be free of the second portions to permit them to move toward the printed circuit card when the movable means is moved away from the retained portions.

2. A device according to claim 1, wherein said movable means is a slide slidably mounted in said case.

3. A device according to claim 1, wherein said first portion of each contact element extends in an inclined direction progressively away from said plane of the printed circuit card.

4. A device according to claim 1, said intermediate portion being a rectilinear portion forming an obtuse angle with the first portion and forming an acute angle with the second portion, wherein said movement of the movable means away from the retained portion moves all of the first, second and intermediate portions toward the printed circuit card.

5. A device according to claim 1, wherein said intermediate portion of each contact element is substantially parallel to said plane of the printed circuit card and has a curved end portion constituting a bend to which said second portion of the contact element is connected, said second portion extending in a direction substantially parallel to said first portion, said movable means first part comprising a cam capable of progressively urging said first portion toward the printed circuit card in said contact closing direction and said second part comprising a projection which is normally capable of maintaining said second portion spaced away from the printed circuit card and allowing it to move toward the printed circuit card in said contact closing direction of movements of said movable means.

6. A device according to claim 1, wherein the resilient contact elements are mounted in and combined with a contact-carrying bar and constitute said unit, said bar defining cavities including slots having a bottom which is so shaped as to axially immobilize said contact elements in planes of said contact elements, said contact elements having a shape similar to said bottom of said slots.

7. A device according to claim 6, wherein said cavities have rib means for gripping the contact elements in said cavities and immobilizing them against a reference surface of the cavity.

8. A device according to claim 1, wherein said contact elements each have tail portions for extending out of said case and are mounted in and combined with contact-carrying bars constituting a plurality of said units, each bar defining cavities whose depths in a region adjacent to said tail portions vary in an alternating manner so as to present said tail portions at alternating different levels.

9. A device according to claim 1, wherein said resilient contact elements are arranged in two rows disposed on opposite sides of the printed circuit card, said rows of contact elements being mounted in and combined with two contact-carrying bars and constituting two of said units, each bar having extensions which together form a guiding and maintaining cavity for an end of the printed circuit card when said card is inserted in said case.

10. A device according to claim 1, wherein said movable means is provided with cavities which form the first and second parts and receive the movable portions of said contact elements, said movable means being slidably mounted in said case by dove-tail guiding means.

11. A device according to claim 10, wherein said control mechanism comprises for each movable means, a bar movable in a further dove-tail guiding means, and pin and groove means for transmitting the movement of the control bar to said movable means.

12. A device according to claim 10, wherein said resilient contact elements are mounted in the case in contact-carrying bars mounted in the case in said dove-tail guiding means, abutment means cooperative with said contact-carrying bars ensuring an immobilization of said contact-carrying bars.

13. A device according to claim 11, wherein said resilient contact elements are mounted in the case in contact-carrying bars mounted in the case in the first said dove-tail guiding means, abutment means cooperative with said contact-carrying bars ensuring an immobilization of said contact-carrying bars.

14. A device according to claim 12, wherein said dove-tail guiding means comprise a groove opening onto a rear side of said case for passage of studs provided on said movable means.

15. A device according to claim 13, wherein the first said dove tail guiding means comprise a groove opening onto a rear side of said case for passage of studs provided on said movable means.

16. A device according to claim 9, wherein said two contact-carrying bars are applied one against the other and have exactly the same shape, said bars being offset from each other so that the cavities of the bars are offset from one another.

17. A device according to claim 1, wherein said second portion of each contact element is extended, beyond its contact zone which contacts the printed circuit card, by a branch which extends away from the printed circuit card and is extended by a bent rearwardly returning portion leading to a second contact zone extended by an end branch extending in the vicinity of said second portion so as to cooperate, as said second portion, with said second part of the movable means, said contact element being made from a wire.

* * * * *